United States Patent [19]

Nakajima

[11] Patent Number: 4,764,038

[45] Date of Patent: Aug. 16, 1988

[54] IMPACT/ELECTROCONDUCTIVE THERMAL PRINTING APPARATUS

[75] Inventor: Hiroharu Nakajima, Kodaira, Japan

[73] Assignee: Canon Kabushiki Kaisha, Tokyo, Japan

[21] Appl. No.: 911,417

[22] Filed: Sep. 25, 1986

[30] Foreign Application Priority Data

Oct. 2, 1985 [JP] Japan ..... 60-220589

[51] Int. Cl.[4] ..... B41J 3/20

[52] U.S. Cl. ..... 400/120; 101/21; 101/32; 400/119; 346/76 PH

[58] Field of Search ..... 400/118, 119, 120, 144.2, 400/241.1; 101/9, 10, 11, 21, 25, 27, 31, 32; 219/216 PH; 346/76 PH

[56] References Cited

U.S. PATENT DOCUMENTS

| | | | |
|---|---|---|---|
| 1,423,290 | 7/1922 | Zeller | 400/120 |
| 2,961,945 | 11/1960 | Braun | 101/27 |
| 3,605,976 | 9/1971 | Angle | 400/120 |
| 3,985,216 | 4/1975 | McIntosh | 400/120 |
| 4,293,233 | 10/1981 | Hoffman | 400/144.2 |
| 4,375,339 | 3/1983 | Dyer et al. | 400/120 |
| 4,456,915 | 6/1984 | Crooks et al. | 346/76 PH |
| 4,502,056 | 2/1985 | Matsuda | 400/120 |
| 4,536,775 | 8/1985 | Calnek et al. | 346/76 PH |
| 4,603,337 | 7/1986 | Erlichman | 400/120 |

FOREIGN PATENT DOCUMENTS

| | | | |
|---|---|---|---|
| 65580 | 5/1980 | Japan | 400/144.2 |
| 154183 | 12/1980 | Japan | 400/120 |
| 161674 | 12/1980 | Japan | 400/120 |
| 89182 | 5/1984 | Japan | 400/120 |

*Primary Examiner*—David Wiecking

*Attorney, Agent, or Firm*—Fitzpatrick, Cella, Harper & Scinto

[57] ABSTRACT

There is disclosed a printing apparatus in which heat and pressure are applied, in a pattern to be printed, to a printing ribbon to ensure clear and rapid printing. The heat is applied via an electroconductible ribbon and type face combination.

6 Claims, 7 Drawing Sheets

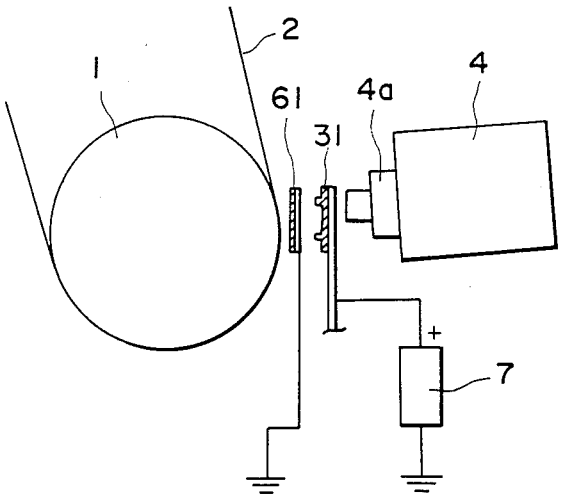
FIG. 3C
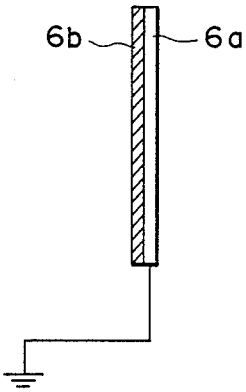
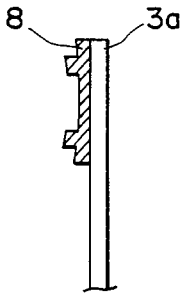
FIG. 3D FIG. 3E

IMPACT/ELECTROCONDUCTIVE THERMAL PRINTING APPARATUS

BACKGROUND OF THE INVENTION

1. Field of the Invention

The present invention relates to a printing apparatus for printing characters, symbols and the like in predetermined patterns.

2. Related Background Art

In the following, conventional printing apparatus are exemplified by a daisy wheel printer employed, for example, typewriters. In such apparatus printing is achieved by transferring an ink layer from an ink ribbon onto a printing sheet, principally by an impact pressure of hammers. Such hammers generate significant sound at printing, thus creating unpleasant noises in the offices where such typewriters are used. Though it has been conceived to reduce the noises through the use of an ink ribbon capable of transferring the ink layer with a low impact pressure, such ink ribbon tends to cause peeling of the ink layer from the substrate film by a winding pressure when such ink ribbon is wound on a core, thus showing inkless portions and being incapable of printing in such portions. Also an easily transferable ink layer tends to cause ink transfer even in the surrounding areas of the characters to be printed, thus deteriorating the quality of the obtained printing.

SUMMARY OF THE INVENTION

In consideration of the foregoing, the object of the present invention is to provide a printing apparatus capable of achieving a high print quality with a low noise level.

Other objects of the present invention will become fully apparent from the following description.

BRIEF DESCRIPTION OF THE DRAWINGS

FIGS. 3C to 3E are lateral views of a part of the typewriter constituting a second embodiment of the present invention;

DESCRIPTION OF THE PREFERRED EMBODIMENTS

Now the present invention will be clarified in detail by embodiments thereof shown in the attached drawings.

Figure 1:
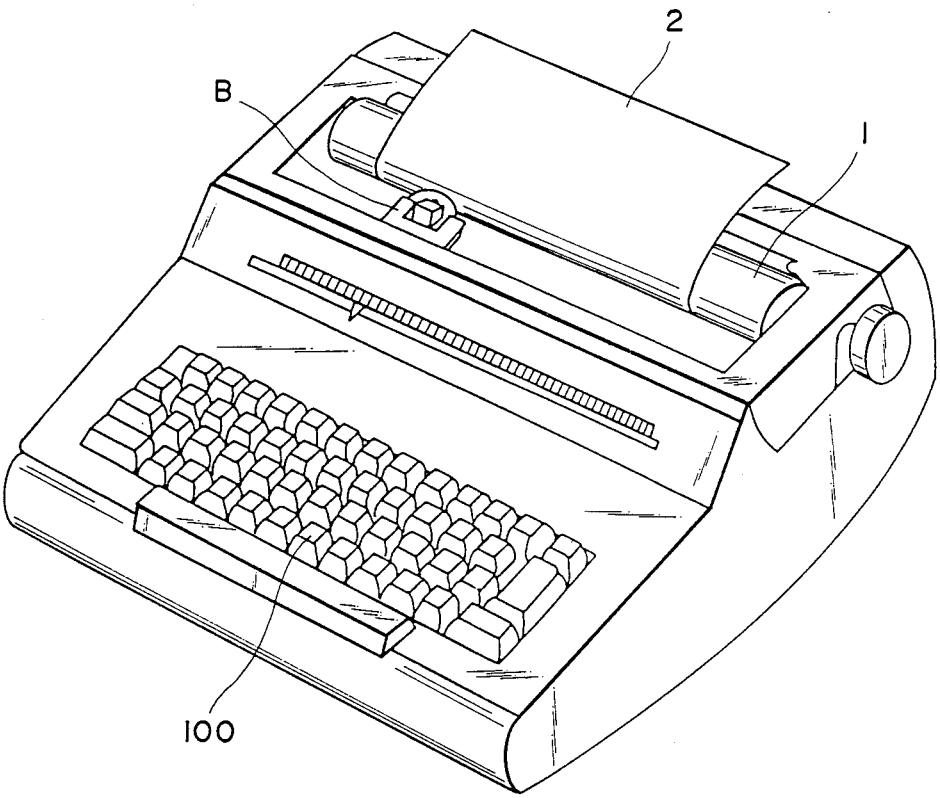
FIG. 1 is a perspective view of a typewriter embodying the present invention.
Figure 2:
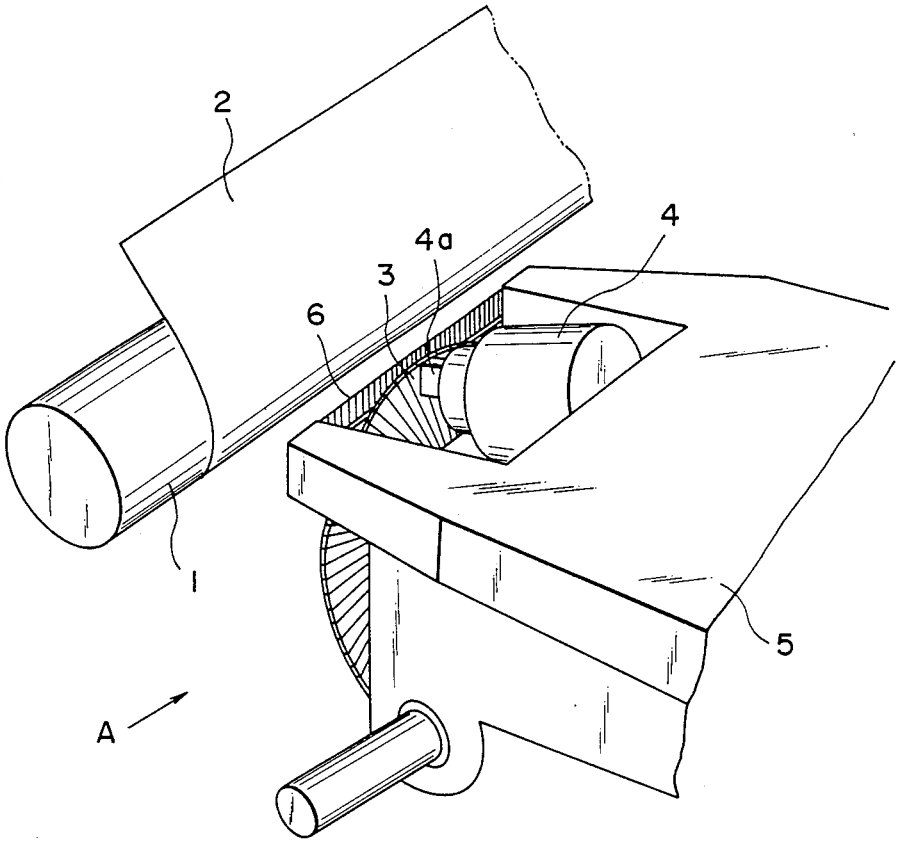
FIG. 2 is a perspective view of a part of the typewriter embodying the present invention.
Figure 3A:
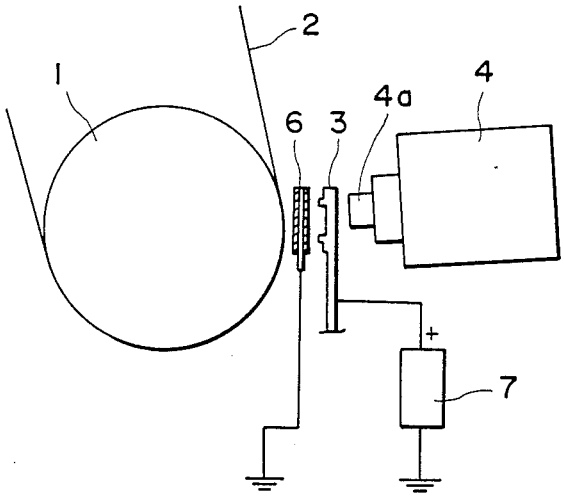
FIGS. 3A and 3B are lateral views of a part of the typewriter constituting a first embodiment of the present invention.
Figure 3B:
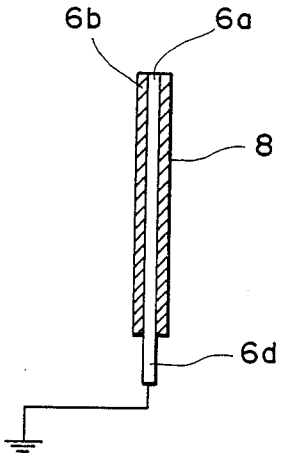
Figure 5:
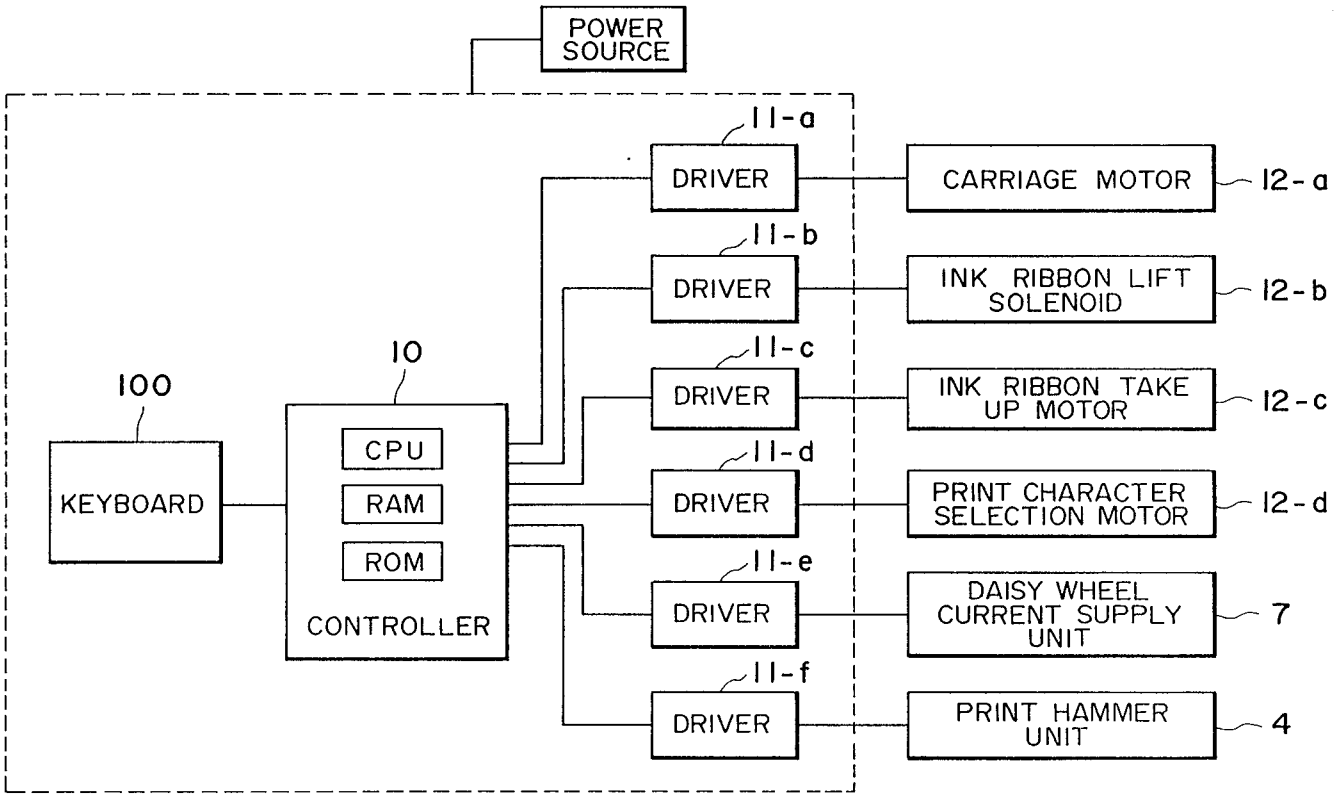
FIG. 5 is a circuit diagram of the first and second embodiments of the present invention.

FIG. 1 is a perspective view of a typewriter embodying the present invention, and FIG. 2 is a perspective view of a carriage B shown in FIG. 1. In FIGS. 1 and 2 there are shown a platen 1; a printing sheet 2 constituting a recording medium; a daisy wheel 3 constituting printing means of a disk shape, having radially extended spokes and printing types provided at the outer ends of the spokes; a solenoid hammer unit 4; a hammer 4*a;* and ink ribbon cassette 5; an ink ribbon 6; and a keyboard 100. The daisy wheel 3, hammer unit 4 and cassette 5 are mounted on a carriage which is movable along the platen 1. FIG. 5 is a control block diagram of the typewriter shown in FIGS. 1 and 2, where a controller 10 is provided with a central processing unit CPU, and memory means such as a read-only memory ROM storing a program shown in FIG. 6 and a random access memory RAM for storing input signals from the keyboard 100, and is adapted to execute processes according to a program. The controller 10 is connected to drivers 11*a*–11*f*, which are respectively connected to a carriage motor 12*a*, an ink ribbon lifting solenoid 12*b*, an ink ribbon take-up motor 12*c*, a print character selecting motor 12*d*, a daisy wheel current supply unit and the hammer unit 4. FIG. 3A is a lateral view of a part of the mechanism shown in FIG. 2, seen from a direction A shown therein. The daisy wheel 3 is made of an electrically conductive material such as a metal, or plated with a metal for obtaining surfacial conductivity, and is charged positively by the daisy wheel current supply unit 7. The ink ribbon 6 is of a three-layered structure, as shown in FIG. 3B, having a conductive layer 6*a* of which a part 6*d* is in contact, inside the cassette 5, with a grounded part of the carriage, an ink layer 6*b* to be transferred onto the printing sheet 2, and a resistance layer 8 which generates heat by an electric current. In the following there will be explained the function of the typewriter of the above-explained structure.

Figure 6:
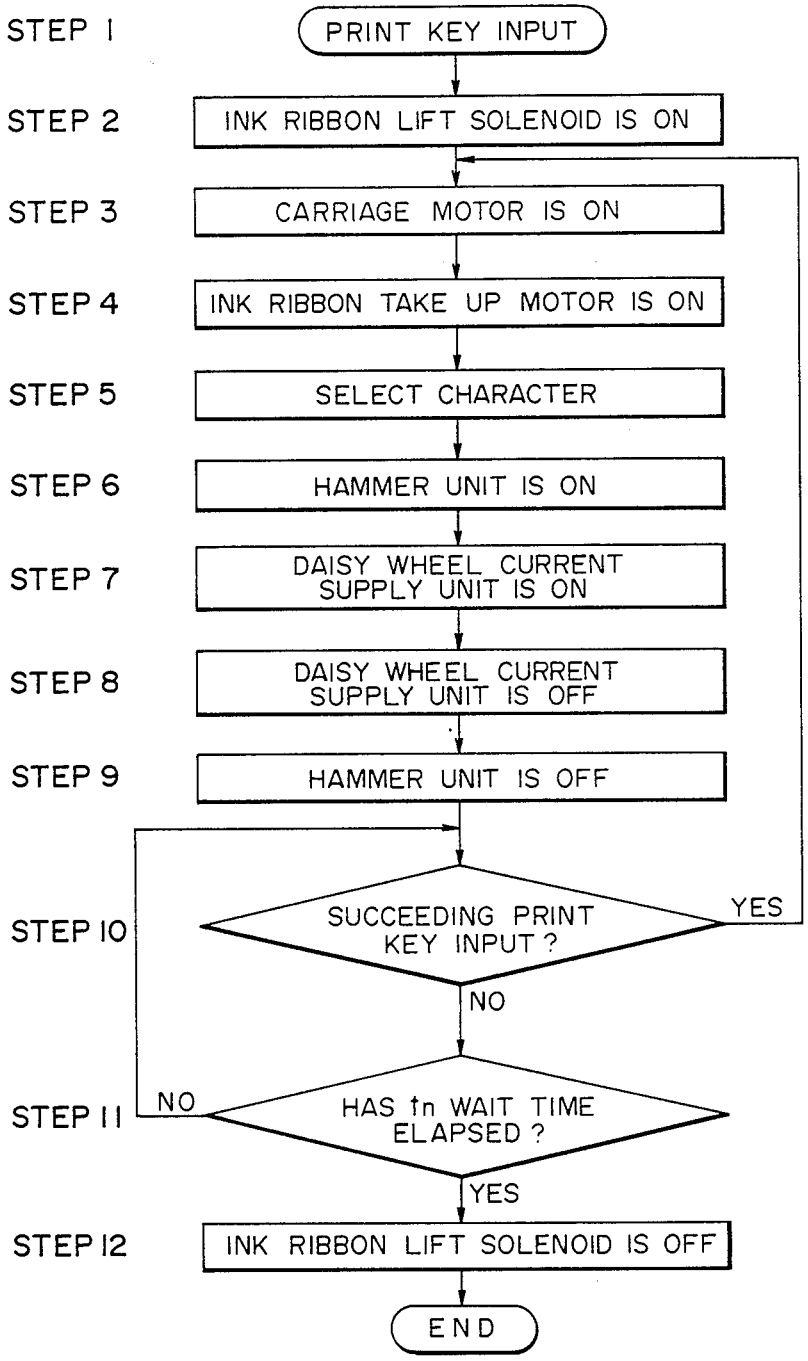
FIG. 6 is a flow chart showing a printing procedure in the first and second embodiments of the present invention.

Referring to FIG. 6, in response to an input through the keyboard 100 in a step 1, a step 2 energizes the ink ribbon lifting solenoid 12*b*, and a step 3 causes the carriage motor 12*a* to laterally displace the carriage B toward a printing position. Then a step 4 activates the ink ribbon take-up motor 12*c* to advance the ink ribbon 6 by an amount corresponding to the printing operation, and a step 5 brings a type of the daisy wheel 3 selected by the character selecting motor 12*d* to a position to be hit by the hammer 4*a*. In this manner the preparation for printing is completed. Then a step 6 causes the hammer 4*a* of the hammer unit 4 to hit the printing type, whereby the printing type, the ink ribbon 6 and the printing sheet 2 are brought into contact to transfer the ink of the ink ribbon 6 onto the printing sheet 2. A step 7 activates the daisy wheel current supply unit 7 to generate a current between the daisy wheel 3 and the ink ribbon 6, as shown in a lateral view in FIG. 4A. A sufficiently strong current is obtained in this state by a suitable voltage control to instantaneously generate heat in the resistance layer 8 in the contacting portion of the daisy wheel 3 and the ink ribbon 6, thereby stimulating the transfer and fixation of the ink layer 6*b* onto the printing sheet 2. The step 8 regulates the duration of the current according to the area of the printing type. Otherwise the aforementioned voltage control may be conducted according to the area of the printing type to achieve secure printing. In any case the printing pressure of the hammer is regulated appropriately according to the character, whether it be a letter, numeral, symbol or the like, to be printed. A succeeding step 9 causes the hammer unit 4 to return the hammer 4*a* to the original position. Then, if a step 10 identifies the entry of a succeeding character from the keyboard 100, the above-explained procedure is repeated. On the other hand, in the absence of such entry for a predetermined period in a step 11, a step 12 deactivates the ink ribbon lifting solenoid l2*b* to return the ink ribbon to a state prior to the printing operation and terminates the printing operation. The improvement in the transfer and fixation of the ink onto the printing sheet 2, caused by the heat generation of the resistance layer 8 at the printing operation in the contact area of the ink ribbon 6 and daisy wheel 3, allows to achieve secure and clear transfer of the ink layer **6*b* to the printing sheet 2 even if the hammer 4*a* has a small impact pressure onto the printing type of the daisy wheel 3**. It is therefore rendered possible to obtain a quiet typewriter and to protect the operator and other people in the offices from the typewriter noises.

Figure 4A:
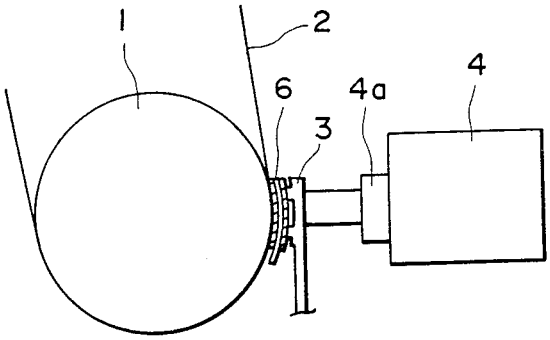
FIG. 4A is a lateral view of the typewriter constituting the first embodiment of the present invention.
Figure 4B:
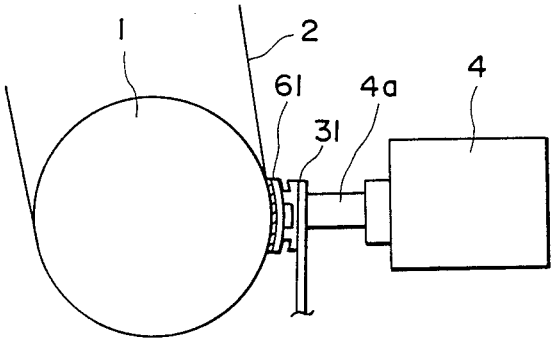
FIG. 4B is a lateral view of the typewriter constituting the second embodiment of the present invention.

Another embodiment is shown in FIGS. 3C, 3D, 3E and 4B, wherein FIG. 3C is a lateral view of the carriage corresponding to FIG. 3A, FIG. 3D is a view of the structure of an ink ribbon 61, FIG. 3E is a view of the structure of the printing type portion of a daisy wheel 31, and FIG. 4B is a view showing the state of printing operation corresponding to FIG. 4A. It is different from the foregoing embodiment shown in FIGS. 3A, 3B and 4A in that the ink ribbon 61 is of a two-layered structure composed of a conductive layer **6*a* and ink layer 6*b*, while the printing type of the daisy wheel 31 is also of a two-layered structure composed of a conductive layer 3*a* and a resistance layer 8**. Other structures are same as in the foregoing embodiment.

In the foregoing embodiments the printing means is comopsed of a daisy wheel, but it may be of any shape such as a ball-shape or a conical shape.

As explained in detail in the foregoing, the impact printer embodying the present invention supplies an electric current to the printing unit and the ink ribbon to generate heat in either thereof at the contact area thereof, thus facilitating the transfer and fixation of the ink of the ink ribbon onto the printing sheet, thereby ensuring secure and clear printing even with a lower impact hammer pressure and thus providing a quieter printing apparatus. This fact allows to protect the operator and other people from the noises caused by printing operation.

What is claimed is:

1. A printing apparatus comprising:

an ink bearing member having an ink layer on a face thereof facing a recording medium and an electroconductible layer on the opposite face thereof;

printing means comprising a plurality of type face pojections to be brought into contact with the electroconductible layer of said ink bearing member, said type face projections being at least electroconductible at said projections and normally maintained at a position spaced from said ink bearing member;

means for applying an electric voltage to a first electrode which is the electroconductible layer of said ink bearing member and to a second electrode which is said type face projections; and hammer means for selectively striking a desired one of said type face projections against said ink bearing member and applying an electric current in the pattern of the selected type face projections, thereby generating heat and thus transferring the ink of said ink bearing member in said pattern of said type face projections onto the recording medium with thermal energy and striking force corresponding to a pattern of the selected type face projection.

2. A printing apparatus according to claim 1, wherein said electroconductible layer of said ink bearing member is composed of a conductible layer of a low resistance and a resistance layer of a high resistance, the former being positioned adjacent to said ink layer on said ink bearing member.

3. A printing apparatus according to claim 1, wherein said printing means is of a disk shape havig plural arms radially extending from a center of rotation and respectively provided with type face projections.

4. A printing apparatus according to claim 1, wherein said printing means comprises a conductible part of a low resistance and a heat generating part of a high resistance, the latter being formed so as to at least appear on a surface of the said type face projections.

5. A printing apparatus according to claim 1, further comprising carriage means supporting said ink bearing member, said printing means, said voltage applying means, and said hammer means and adapted to move along said recording medium.

6. A printing appartus according to claim 1, wherein said ink bearing member bears said ink layer directly on said electroconductible layer.

* * * * *

UNITED STATES PATENT AND TRADEMARK OFFICE

CERTIFICATE OF CORRECTION

PATENT NO. : 4,764,038

DATED : August 16, 1988

INVENTOR(S) : HIROHARU NAKAJIMA

It is certified that error appears in the above-identified patent and that said Letters Patent is hereby corrected as shown below:

COLUMN 1

Line 13, "typewriters." should read --in typewriters.--.

COLUMN 2

Line 3, "and" should read --an--.

COLUMN 3

Line 33, "comopsed" should read --composed--.

COLUMN 4

Line 45, "appartus" should read --apparatus--.

Signed and Sealed this

Second Day of May, 1989

*Attest:*

DONALD J. QUIGG

*Attesting Officer*

*Commissioner of Patents and Trademarks*